United States Patent [19]

Lindgren

[11] 4,375,389

[45] Mar. 1, 1983

[54] COKE OVEN DOOR CLEANER

[75] Inventor: Carl Lindgren, Glenshaw, Pa.

[73] Assignee: Koppers Company, Inc., Pittsburgh, Pa.

[21] Appl. No.: 298,645

[22] Filed: Sep. 2, 1981

[51] Int. Cl.[3] ..... B23D 79/04; B23D 79/06; C10B 43/04

[52] U.S. Cl. ..... 202/241; 15/93 A

[58] Field of Search ..... 202/241; 201/2; 15/93 A

[56] References Cited

U.S. PATENT DOCUMENTS

| | | | |
|---|---|---|---|
| 3,343,193 | 9/1967 | Ciochetto | 15/93 A |
| 3,448,475 | 6/1969 | Stanke | 15/93 A |
| 3,577,321 | 5/1971 | Schaten | 202/241 |
| 3,609,786 | 10/1971 | Stanke et al. | 15/93 A |
| 3,741,806 | 6/1973 | Stanke et al. | 15/93 A |
| 3,822,191 | 7/1974 | Konno | 202/241 |
| 4,025,979 | 5/1977 | Stanke et al. | 202/241 |
| 4,110,171 | 8/1978 | Baird et al. | 202/241 |
| 4,300,257 | 11/1981 | Ibe et al. | 202/241 |
| 4,300,986 | 11/1981 | Akira et al. | 202/241 |

FOREIGN PATENT DOCUMENTS

| | | | |
|---|---|---|---|
| 38-5003 | 4/1963 | Japan | 15/93 A |
| 910590 | 11/1962 | United Kingdom | 15/93 A |

*Primary Examiner*—Bradley Garris

*Attorney, Agent, or Firm*—Daniel J. Long; Herbert J. Zeh, Jr.; Oscar B. Brumback

[57] ABSTRACT

An apparatus that employs a pair of high peripheral speed impact cutters to remove hard carbonaceous deposits from the lateral surfaces of the refractory lining of coke oven doors. The motion of these cutters is synchronized with that of an element of the apparatus which displaces it from one position to another on the door, and, in one embodiment, means are also provided to scrape tarry carbonaceous deposits from the door's seal ring.

17 Claims, 12 Drawing Figures

COKE OVEN DOOR CLEANER

BACKGROUND OF THE INVENTION

1. Field of the Invention

The present invention deals with coke ovens and, in particular, with devices for cleaning coke oven doors.

2. Description of the Prior Art

Coke ovens are generally equipped at their ends with refractory lined doors which are removable to allow a charge to be pushed from an oven on completion of the coking process. After pushing it is often necessary to remove carbonaceous material from the oven door's peripheral seal ring and from the lateral surfaces of the refractory before the door is replaced. The carbonaceous material which accumulates on the seal ring generally consists of a viscous, tarry distillation product which is evolved during the coking process and which often may be satisfactorily removed by a scraping procedure. The refractory lateral surfaces of the coke oven doors, on the other hand, usually collect a different type of carbonaceous deposit. Such deposits generally consist of a hard carbonaceous material which strongly adheres to the lateral surfaces and which often accumulates to a considerable thickness so as to resist removal by the scraping methods used on the tarry distillation product.

Various devices have been suggested for cleaning coke oven doors. U.S. Pat. No. 3,448,475, for example, discloses a rotary door cleaner having two scraper tools which are pivotally interconnected to rotate about a common axis so that the seal ring surfaces and the lateral surfaces can be simultaneously scraped. While such scraping devices have been found to be effective in removing the aforementioned tarry deposits from the seal ring, it is found that a scraping action often fails to remove all of the accumulated hard carbonaceous deposits from the lateral surfaces of the door. Accordingly, it is sometimes necessary to remove these hard carbonaceous deposits by laborious methods such as by the use of jack hammers or the like. It is, therefore, the object of the present invention to provide a coke oven door cleaner that effectively removes such hard carbonaceous deposits and which, furthermore, permits improved operating efficiency due to the synchronization of its cleaning and propulsion elements.

SUMMARY OF THE INVENTION

The present invention is a coke oven door cleaner which has a pair of rotary high peripheral speed impact cutting drums which remove carbon from the lateral surfaces of coke oven doors. These rotary cutting drums are connected by a system of shafts and reduction gearing to an output pinion ring, the rotation of which displaces the cleaner on a vertical support from the bottom to the top of the oven door so that the rate at which the cleaner advances up the oven door will be proportional to the speed of its cutting drums. In one embodiment of this invention, means are also provided to simultaneously scrape the tarry deposits from coke oven door seal rings.

BRIEF DESCRIPTION OF THE DRAWINGS

The present invention is more fully described in the accompanying drawings in which.

DETAILED DESCRIPTION

Figure 1:
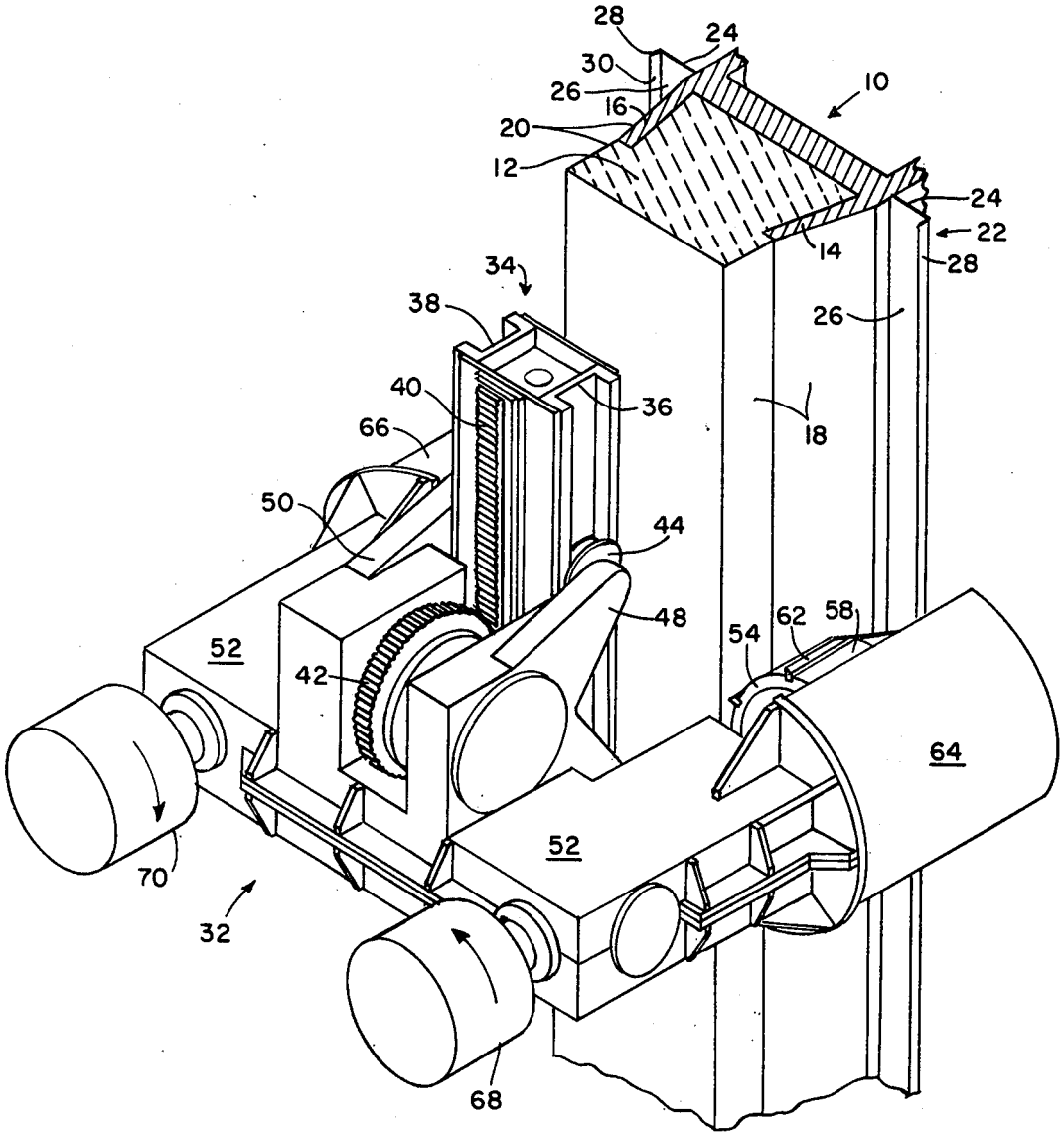
FIG. 1 is a perspective view of the apparatus of the present invention.

Referring to FIGS. 1–5, there is shown, in fragment, a self sealing coke oven door generally designated by the numeral 10. The door 10 includes a refractory plug 12 which is inserted into the coke oven during the coking process. The refractory plug is held onto the door by a pair of metal refractory plug retainer flanges 14 and 16. The external, lateral surfaces of the refractory plug 12 and retainer flanges 14 and 16 makeup, respectively, lateral surfaces 18 and 20 from which hard carbonaceous deposits must be periodically removed. The coke oven door is also characterized by a peripheral metal seal ring 22 which has a laterally extending body portion 24, on which there is an external surface 26, and an inwardly flanged end portion 28, on which there is an inner surface 30. The seal ring surfaces 26 and 30 are those from which it is generally necessary to remove the above mentioned tarry distillation product.

Figure 2:
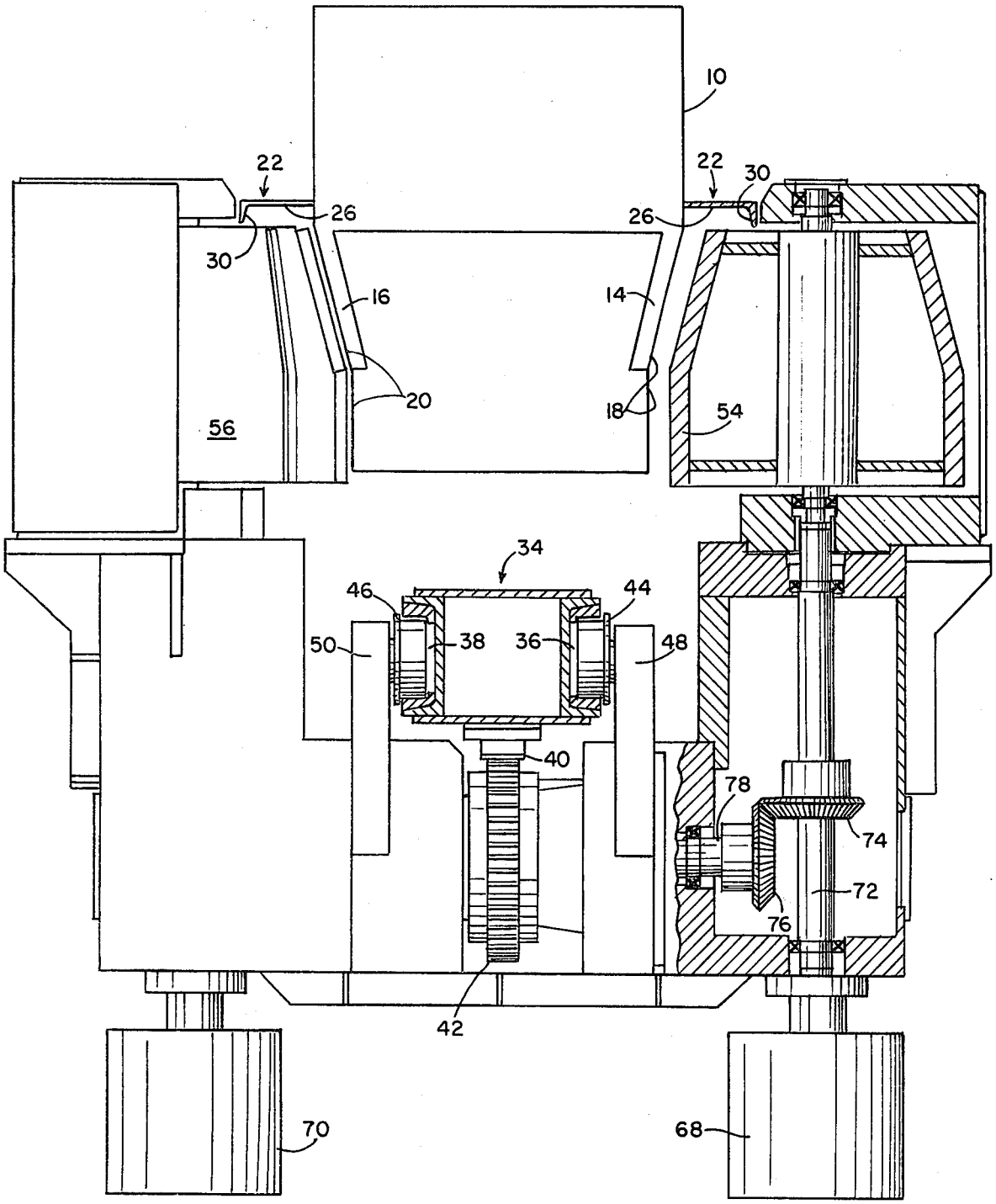
FIG. 2 is a cut away plan view of the apparatus shown FIG. 1.

Removal of hard carbonaceous deposits from the surfaces 18 and 20 may be effected by means of the coke oven door cleaner of the present invention shown generally at numeral 32. Preferably when the door 10 is being held on a door machine, the door cleaner 32 may be supported adjacent the door on a support column shown, in fragment, at numeral 34. The support column is preferably suspended from a carrier on a universal joint (not shown) and is characterized by side grooves 36 and 38 and a front rack 40 which engages a pinion ring 42 on the door cleaner so as to allow vertical movement of the door cleaner 32 on the support column 34. Wheels 44 and 46 which are attached by means of arms 48 and 50 to the housing 52 of the door cleaner also engage the support, respectively, at grooves 36 and 38. The door cleaner also is further stabilized on the vertical support by two other wheels (not shown) which run in grooves 36 and 38 below wheels 44 and 46. The door cleaner is also equipped with two generally cylindrical cutting drums 54 and 56 which are adapted in shape so that their curved, peripheral cutting surfaces 58 and 60, respectively conform to lateral surfaces 18 and 20 on the door. Cutting drums 54 and 56 each also have a plurality of radially outwardly extending cutting blades such as at 62 on their cutting surfaces 58 and 60 which are longitudinally arranged at equal circumferential intervals on said cutting surfaces. It will also be seen that cutting drums 54 and 56 are partially shielded by means of detachable cutter heads 64 and 66 and that the door cleaner 32 is also equipped with hydraulic motors 68 and 70. Referring particularly to FIG. 2, it will be seen that hydraulic motor 68 drives through shaft 72 which rotates beveled gears 74 and 76 and finally common shaft 78. From both FIG. 2 and FIG. 3 it will be seen that hydraulic motor 70 drives through shaft 79 which is connected to common shaft 78 by a similar beveled gear arrangement, such that the motions of the through shafts 72 and 79 are synchronized with each other.

Figure 3:
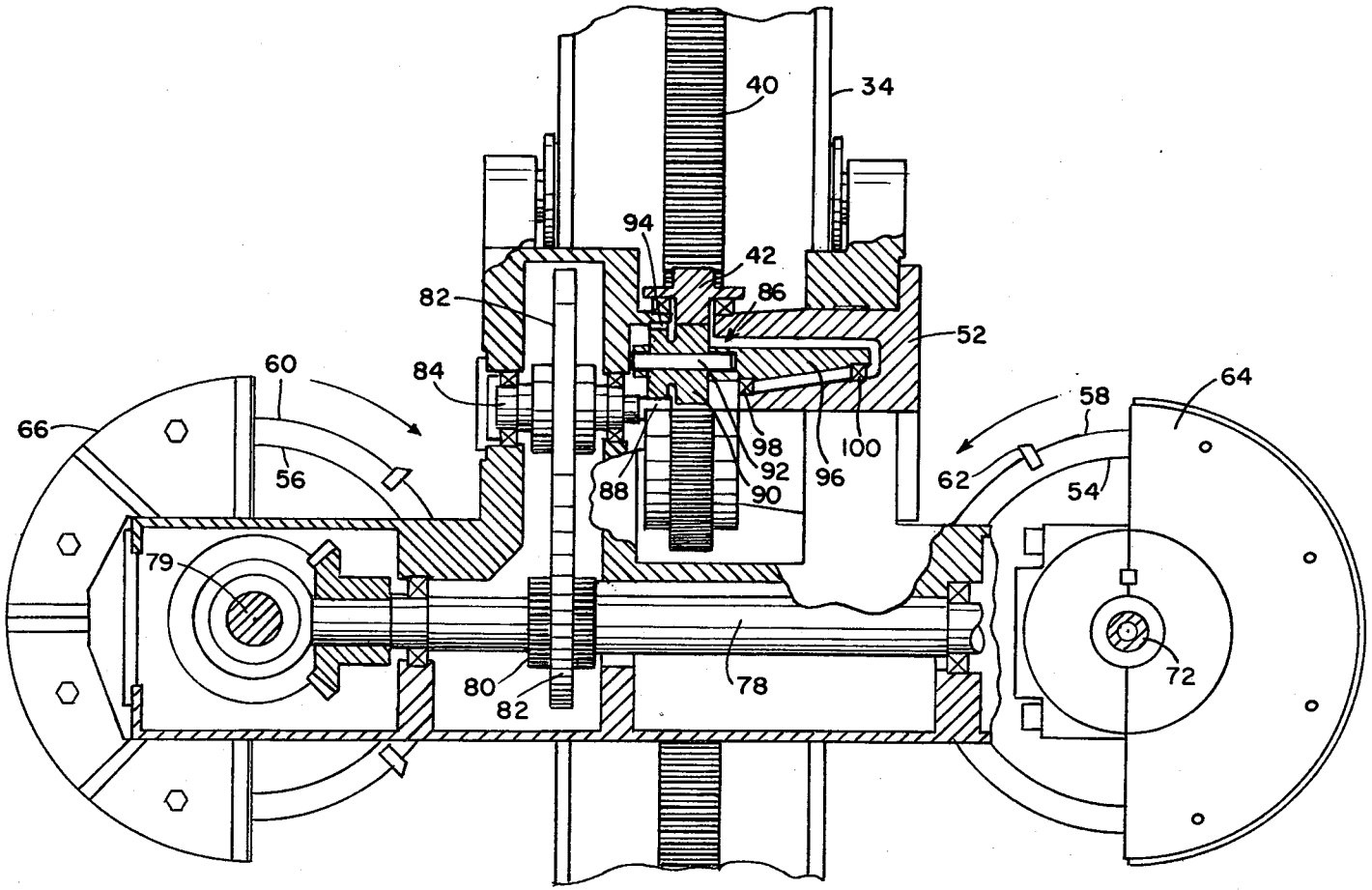
FIG. 3 is a cut away front elevational view of the apparatus shown in FIG. 1.
Figure 4:
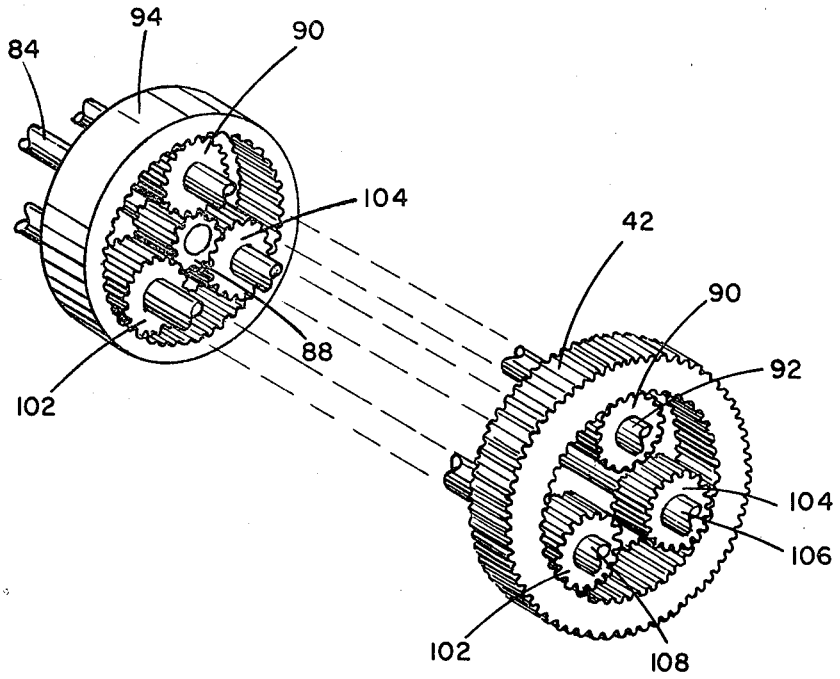
FIG. 4 is a stage separated perspective view of part of the gearing arrangement shown in FIG. 1.

From FIG. 3 it will also be observed that the motion of common shaft 78 is translated by way of spur gear 80 to spur gear reduction output ring 82 which, itself, rotates sun gear shaft 84. Sun gear shaft 84, in turn, drives a planetary gear system which is shown generally at numeral 86. This planetary gear system is made up of a sun gear 88, planet gear 90 and planet gear shaft 92 as well as two other planet gears and their shafts not shown in FIG. 3, fixed internal gear 94, planetary gear carrier 96 and its bearings 98 and 100, and output pinion ring 42. FIG. 4 shows the essential features of this planetary gearing system and has been stage separated to more clearly show its operation. Referring to both FIGS. 3 and 4, it will be seen that sun gear shaft 84 rotates sun gear 88 which, in turn, rotates planet gear 90 and shaft 92, as well as planet gears 102 and 104 and their shafts 106 and 108. Internal gear 94 is fixed so that the planet gears move internally on it and about the sun gear and at the same time drive the output pinion ring 42 on the rack 40 on the support column 34 so as to vertically displace the door cleaner thereon. It is noted that planetary gear carrier 96 rotates on bearings 98 and 100 in the fixed cleaner housing 52. It will also be observed that, when viewed from the front, the hydraulic motor 68 and through shaft 72 are rotated in a counterclockwise direction and the hydraulic motor 70 and its corresponding through shaft are rotated in a clockwise direction so that the cleaner 32 advances up the support column 34. By changing the direction of the hydraulic motors the cleaner 32 can be lowered on the support column 34.

Figure 5:
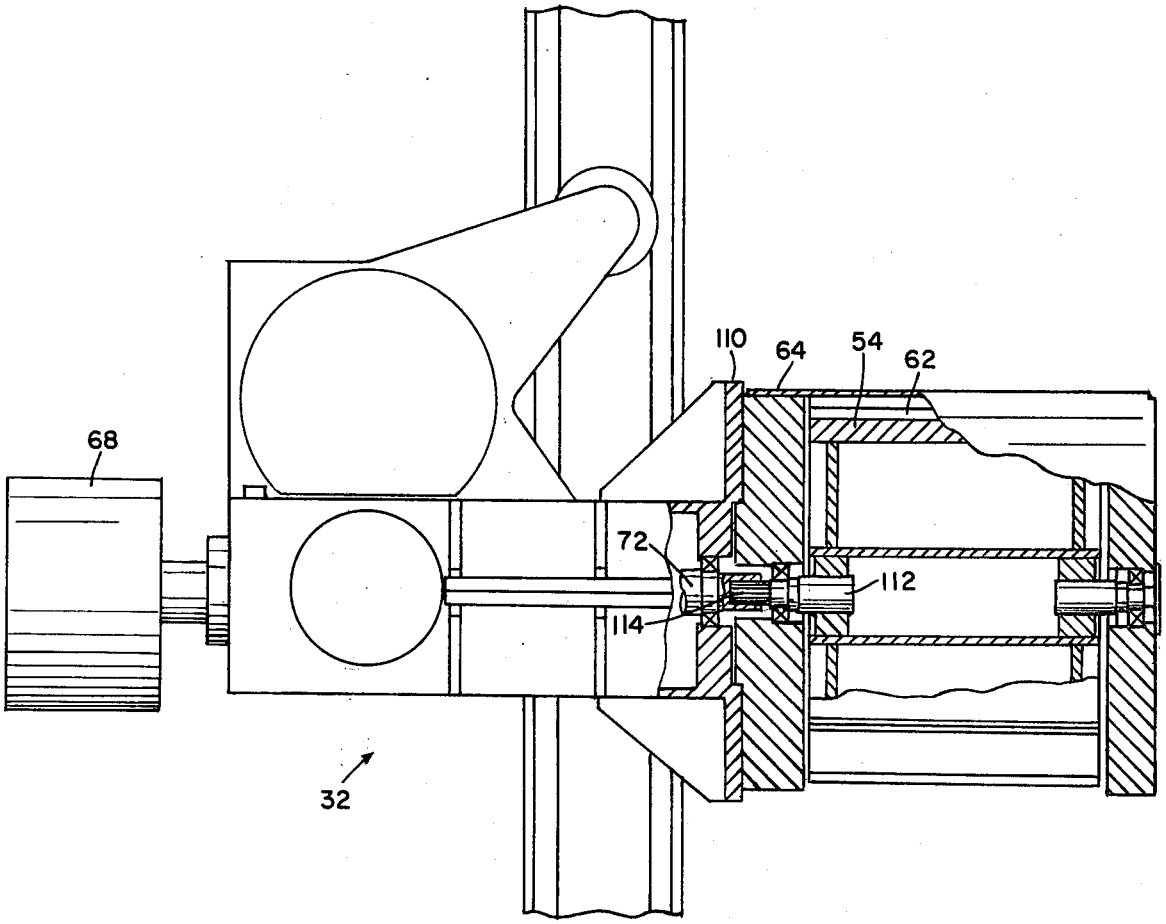
FIG. 5 is a cut away side elevational view of the apparatus shown in FIG. 1.

FIG. 5 shows that cleaner head 64 abuts a flange 110 on cleaner housing 52 and is detachable from the cleaner housing at that point. Cutting drum 54 rotates about a drum shaft 112 which is detachably connected to through shaft 72 by means of an internal-external spline 114 so that the cleaner drum is directly driven by the hydraulic motor 68. The cutting drum 56 is similarly configured and driven by hydraulic motor 70. It will, thus, be observed that the rotation of the two cutting drums is synchronized with one other. Furthermore, the planetary gearing system described above provides sufficient reduction so that the motion of the output pinion ring is also advantageously synchronized with that of the cutting drums so, as is pointed out below, to allow a high speed rotation of the cutting drums. Thus, because the blades on the cutting drums are spaced at regular intervals, they will cut constant sized bites from the carbon deposits on surfaces 18 and 20 as the door cleaner 32 advances from the bottom to the top of the door since the rate of the cleaner's ascent on support column 34 will be proportional to changes in the angular velocities of the cutting drums 54 and 56. Depending, then, on the nature and thickness of the carbon deposits which are to be removed, it may be possible to select, beforehand, an optimum size and placement for the blades and an optimum operating speed for the cutter so that it will, without being continually adjusted by its operator, remove the desired amount of accumulated carbonaceous material while it progresses up its support from the bottom to the top of the coke oven door. The cleaner's operator should not, therefore, have to continuously monitor the degree to which the cleaner has reduced deposits in a particular area so as to move the cleaner to another area, at the appropriate time. Furthermore, it would also be unlikely that the operator would inadvertantly overtax the cleaner's motors if such optimum speed and blade setting conditions were observed.

It is also noted that various features of the cleaner allow for a high peripheral speed on the cutting surfaces and, thus, an enhanced effectiveness for the cleaner. It has been found that the hard carbonaceous material accumulated on the lateral surfaces of coke oven doors has a relatively low compressive strength so that the effectiveness of a cleaner in removing such accumulations would probably be generally proportional to the energy applied by a cutter to the hard carbonaceous deposits or the square of the velocity of the cutter's impacting element. Unlike the high torque, small diameter cutters which might be more effectively employed on materials such as most metals, it is suggested that a large diameter, high peripheral speed impact cutter would be the preferred apparatus for use on these hard carbonaceous deposits. Thus, it will be observed that the apparatus of the present invention includes several features which allow the cutter drums to be operated at a high peripheral speed. These features include the direct drive connection between the cutting drums and the hydraulic motors, the large diameter of the cutting drums, and the reduction gearing between the rapidly rotating common shaft and the necessarily slower output pinion. In keeping with the purpose of the inclusion of these features in present invention, the hydraulic motors are preferably operated at a speed which would ensure a relatively high peripheral speed on the cutting surfaces of the cutting drums so as to obtain the enhanced effectiveness which would be expected to accrue from applying additional energy in impacting the carbonaceous deposits. As to the fracture mechanics of the hard carbonaceous deposits, themselves, it is believed that for most deposits and embodiments of the present invention, these deposits will be removed in rough-edged pieces by high speed impact fracture. It may, however, also be possible, with the apparatus of the present invention, to cut these deposits into smooth-edged pieces or to grind them into a powder. It should, therefore, be understood that the use, herein, of the terms "cutter" and "cutting" in describing elements of the apparatus of the present invention is not to be narrowly construed as referring only to an element which removes smooth-edged pieces of the carbonaceous deposits. Instead, these terms refer to any rotary impacting element which removes or reduces hard carbonaceous deposits whether by fracture in rough-edged pieces, by cutting in smooth-edged pieces, or by grinding these deposits into a powder.

A second embodiment of the present invention is illustrated in FIGS. 6–9. This embodiment is also shown in conjunction with a coke oven door 210 which has a refractory plug 212 and refractory retainer flanges 214 and 216, which together have, respectively, external lateral surfaces 218 and 220 from which carbonaceous material may have to be removed. Metal seal ring 222, likewise, has surfaces 226 and 230 which may also require cleaning. As was heretofore noted, however, most of the buildup of hard carbonaceous material is likely to be on surfaces 218 and 220 rather than on seal ring surfaces 226 and 230. Since the tarry deposits which will be likely to accumulate on seal ring surfaces 226 and 230 will probably be suitable for removal by scraping, this embodiment is characterized by a dual cleaner in which a cutting means is provided for removal of the hard deposits on lateral surfaces 218 and 220 and in which a scraping means removes the tarry deposits on seal rings 226 and 230.

Figure 6:
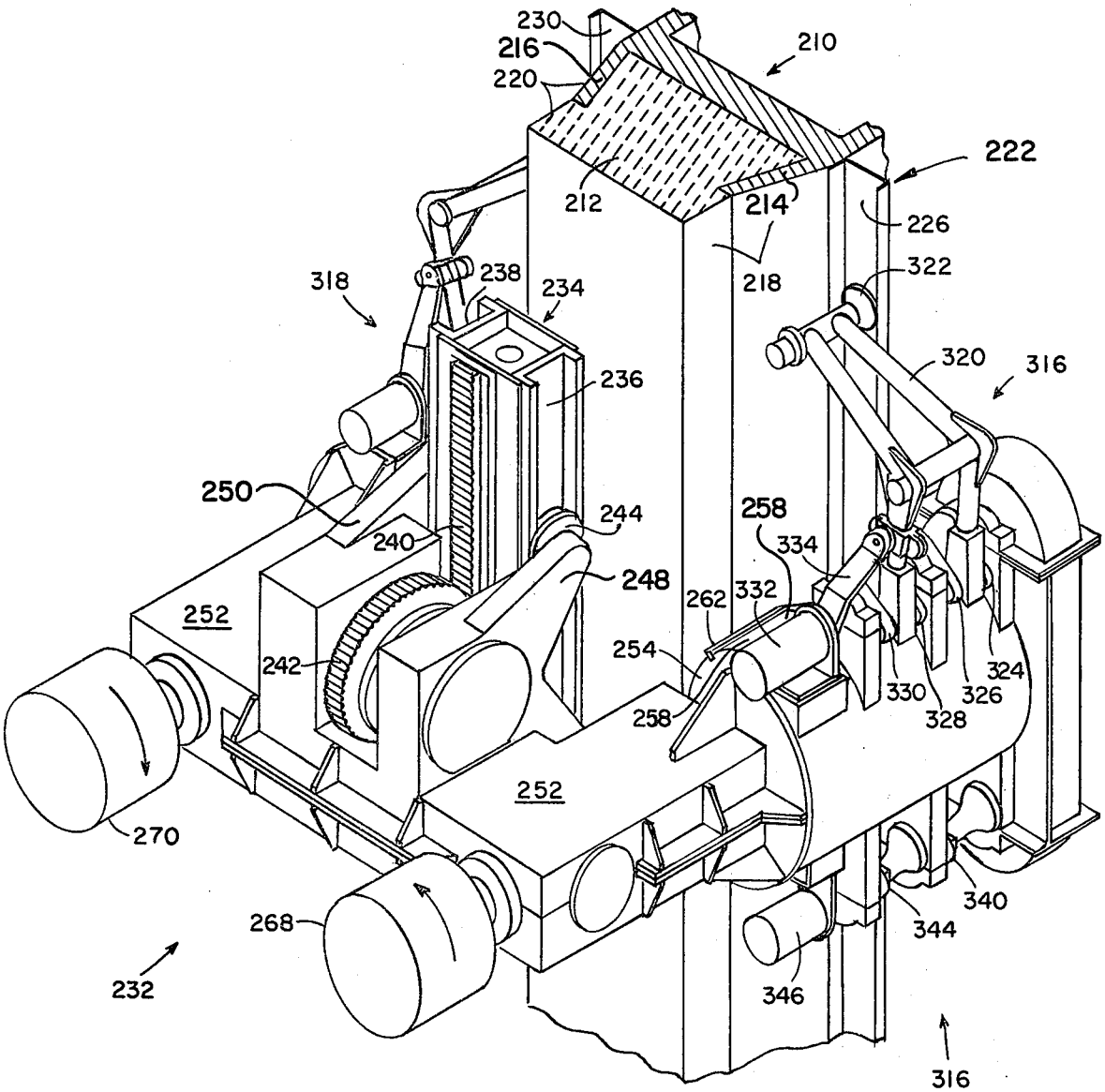
FIG. 6 is a perspective view of a second embodiment of the apparatus of the present invention.
Figure 7:
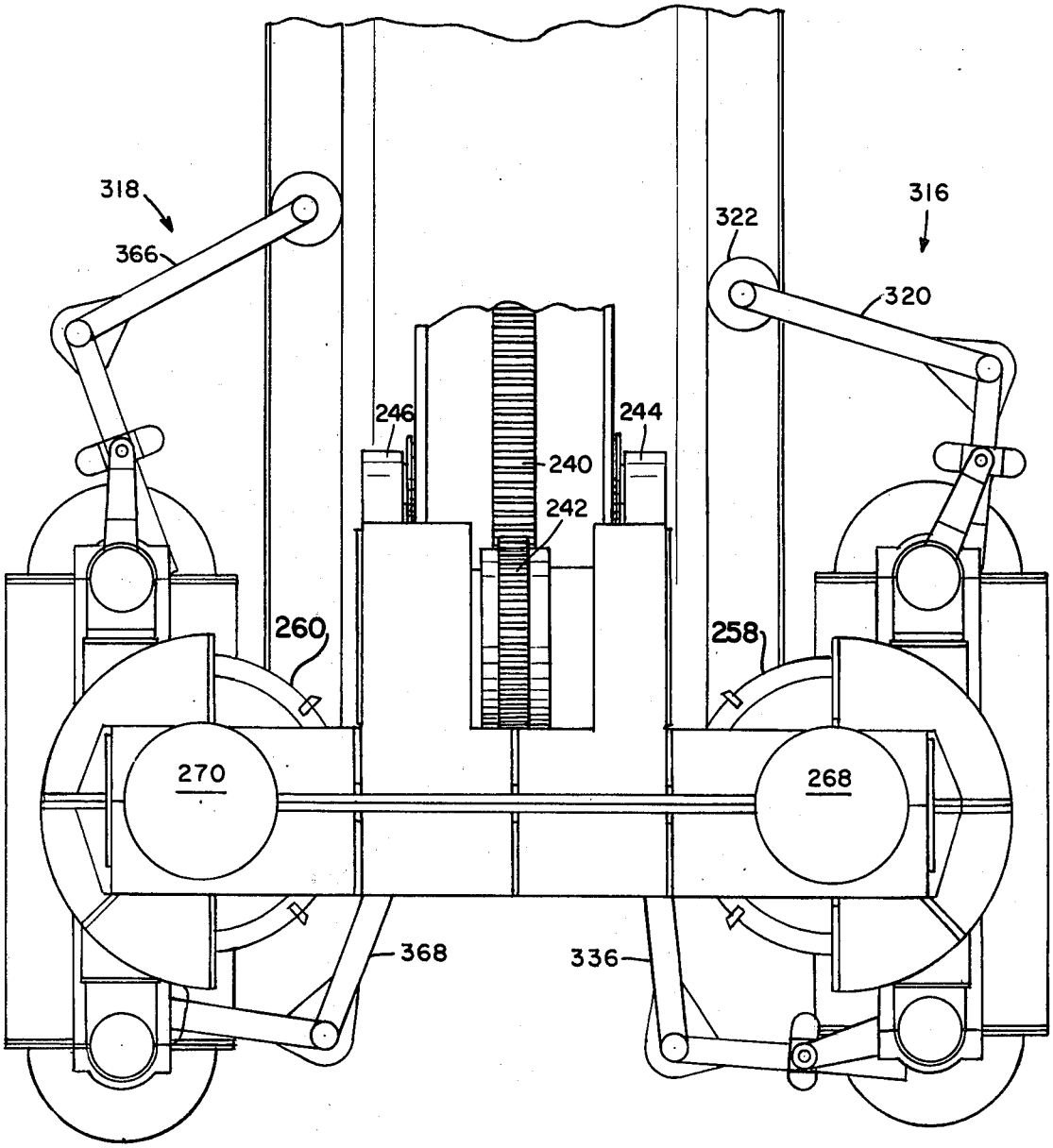
FIG. 7 is a front elevational view of the apparatus shown in FIG. 6.
Figure 8:
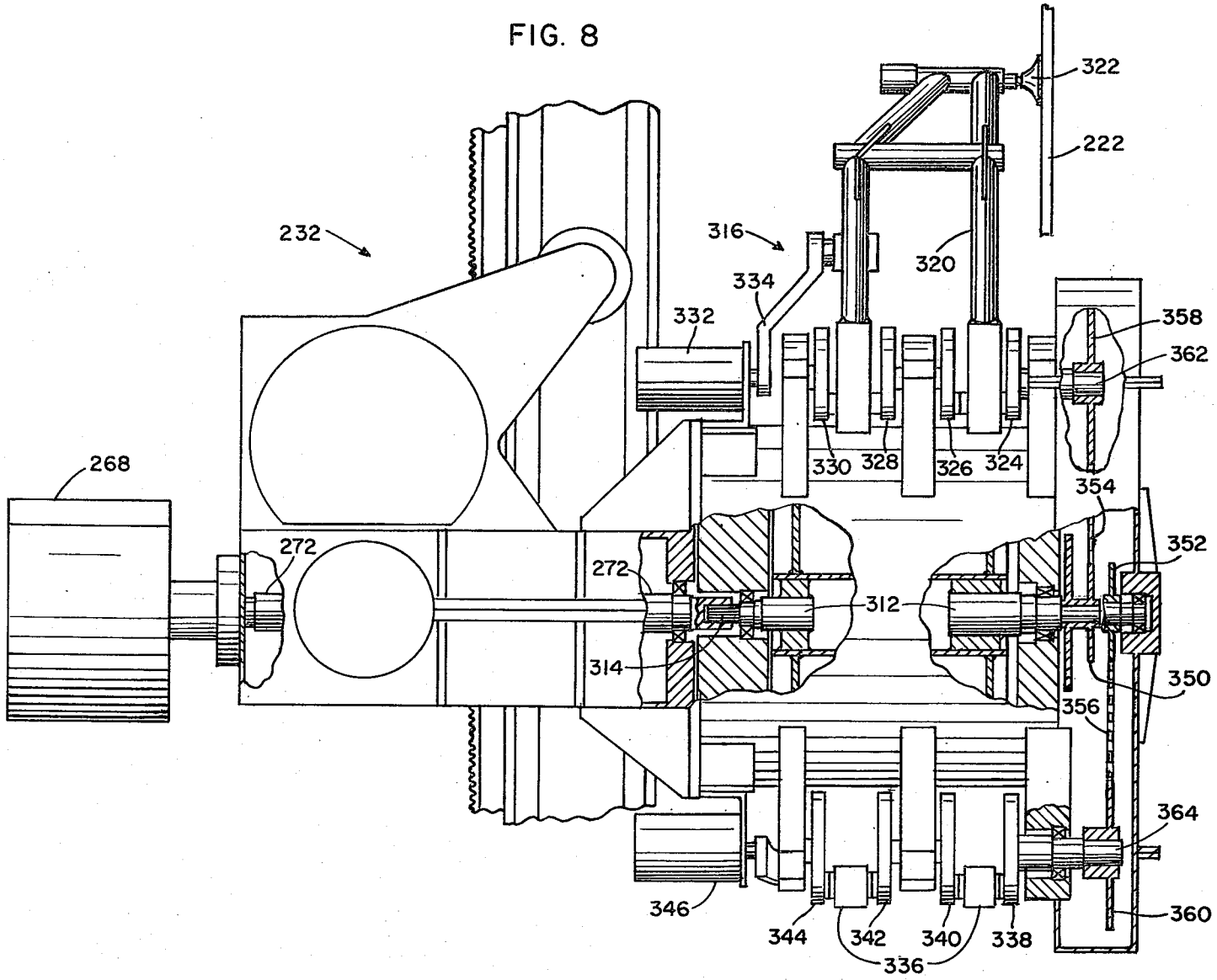
FIG. 8 is a cut away side elevational view of the apparatus shown in FIG. 6; and FIGS. *9a–9d* are diagrammatic views in fragment of a coke oven door with schematic illustrations of the operation of the device shown in FIG. 6.

Referring to FIGS. 6–8, it will be seen that this embodiment includes a rotary door cleaner 232 which is substantially similar in configuration and function to the rotary door cleaner 32 shown in FIGS. 1–5 with the exception of the fact that the seal ring surface scraper assemblies, shown generally at 316 and 318, are substituted for the cutter heads 64 and 66 of door cleaner 32. It will, for example, be observed that door cleaner 232 is powered by two hydraulic motors 268 and 270 and that it is supported by wheels 244 and 246 which engage, respectively, grooves 236 and 238 of support column 234 and which are connected to cleaner housing 252 by arms 248 and 250. Inside housing 252 a system of interconnected shafts and gearing substantially identical to the one described in connection with door cleaner 32 drives pinion ring 242 on rack 240 so as to allow for the vertical displacement of the door cleaner on the support column 234 and for the rotation of the cutting drums with their peripheral cutting surfaces 258 and 260 with cutting blades as at 262.

The scraper assembly 316 has an upper scraper arm 320 having at one end a terminal scraper element 322 abutting seal ring surfaces 226 and 230 and being connected at its lower end to cranks 324–330. Upper scraper arm 320 is also connected to a hydraulic dampener and positioning activator 332 by arm 334. Scraper assembly 316 also has a lower scraper arm 336 also having at its terminal end, a scraper element (not shown) which is similar to scraper element 322, and which is positioned so as to abut surfaces 226 and 230. Lower scraper arm 334 is also connected at its lower end to cranks 336–344, and to hydraulic dampener and positioning activator 346 by arm 348.

From FIG. 8 it will be observed that hydraulic motor 268 of door cleaner 232 rotates through shaft 272. Through shaft 272 is connected to drum shaft 312 by internal-external spline 314 and drum shaft 312 is, thus, directly driven by hydraulic motor 268. As with the first embodiment herein, the drum shaft 312 rotates the cutting drum 254 so as to remove carbonaceous deposits from surface 218. Additionally, the drum shaft 312 rotates chain sprockets 350 and 352 which, respectively, drive chains 354 and 356, so as to rotate, respectively, chain sprockets 358 and 360. Chain sprockets 358 and 360 drive, respectively, upper crank shaft 362 and lower crank shaft 364 which, themselves, rotate respectively, cranks 324–330 and cranks 338–344. It will be observed that the rotational motion of the crank shaft 360 is by means of the arrangement of cranks 324–330 and arm 320 translated to linear motion by the upper scraper element 322 up and down on surfaces 224 and 230 on the side portion of seal ring 222 or back and forth on the top portion of the seal ring. Preferably, cranks 338–344 are out of phase with cranks 324–330, but the similar configuration of these cranks and lower scraper arms 336 allows the lower scraper element to be driven linearly back and forth or up and down on the bottom or side portion of seal ring 222. In this way, tarry carbonaceous deposits are effectively removed from seal ring surfaces 224 and 230 by the scraper elements while hard carbonaceous deposits are cut from lateral surfaces 218 and 220 by the cutting blades.

As will be noted from FIG. 7, the seal ring scraper assembly 318 is, in configuration and operation, substantially similar to seal ring scraper assembly 316 except that it is preferred that the upper arm 366 and the lower arm 368 of scraper assembly be initially positioned and then subsequently operated so that they are out of phase, respectively, with the upper arm 320 and lower arm 336 of scraper assembly 316. Owing to the fact that the motion of the through shafts attached to the hydraulic motors 268 and 270 are synchronized by a common shaft as was heretofore described, the motion of the upper arms 320 and 366 and the lower arms 334 and 368 will be synchronized and will remain out of phase with one another if they are initially positioned in that way.

Figure 9A:
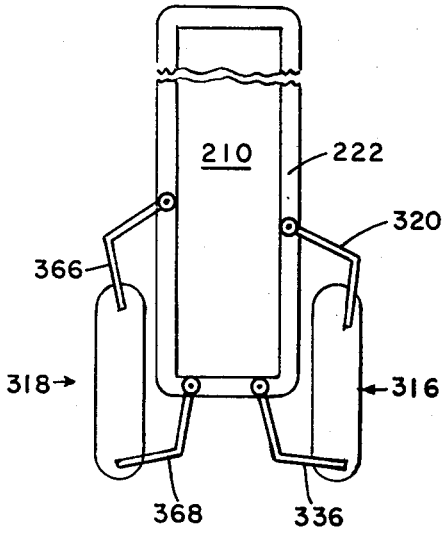
Figure 9B:
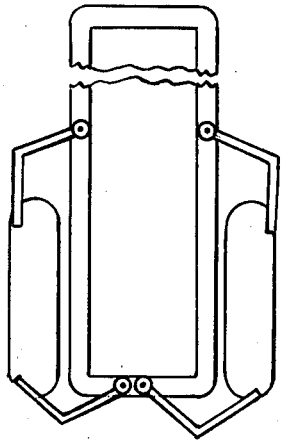
Figure 9C:
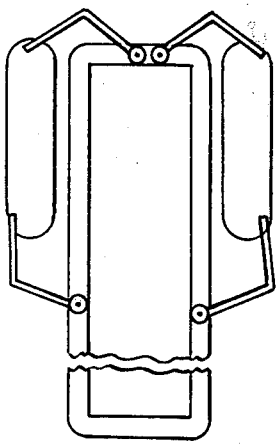
Figure 9D:
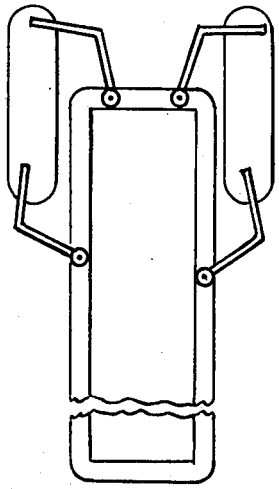

FIGS. **9*a*–9*d* show the position of the scraper assemblies 316 and 318 on the seal ring 222 at four successive points in time as the door cleaner advances up the vertical support column. When the door cleaner is initially positioned at the lower part of the coke oven door, the scraper assemblies will scrape the lower part of the seal ring as is shown in FIG. 9*a*. From FIG. 9*a* it will be observed that the abovementioned synchronization allows the terminal scraper elements on lower arms to 336 and 368 to move back and forth on seal ring 222 and to alternatively scrape a common intermediate section of the seal ring 222. As the pinion ring rotates so as to elevate the door cleaner on the support column, the scrapers on the upper arms will also move upwardly so as to scrape the higher sections of side portions of seal ring 222 as shown in FIG. 9*b*. The corners between the lower and side parts of seal ring 222 are, by conventional methods, particularly difficult to clean, but the scrapers on the ends of lower arms 336 and 368 can be reciprocated around those corners so as to effectively clean them. FIG. 9*c* shows the scraper assemblies at a still higher position on the side portion of seal ring 222, and from FIG. 9*d* it will be seen that when the door cleaner 232 reaches the vicinity of the top of door 210, the upper arms 320 and 366 will be positioned on the upper section of seal ring 22 and will scrape the same by the above described reciprocating motion. Since the motion of the upper arms 320 and 366 is synchronized, these arms will, if initially properly positioned, be able to scrape a common, intermediate section of seal ring 222** without interfering with each another.

It is noted that as the door cleaner 232 progresses upward and the scraper assemblies 316 and 318 clean the seal ring 222, the cutting drums 254 and 256 also remove hard carbonaceous deposits from the surfaces 218 and 220. Thus, there is provided an apparatus which effectively removes both viscous tarry material, as well as hard carbonaceous deposits from coke doors in a single efficient operation. It is also noted that a certain amount of hard carbonaceous material may also tend to accumulate on the lower portions of the seal ring, and it is found that a scraping element which consists of a disc that rotates about its central axis is particularly effective in removing those deposits.

Although the invention has been described with a certain degree of particularity, it is understood that the present disclosure has been made only as an example and that the scope of the invention is defined by what is hereafter claimed.

What is claimed is:

1. A self displacing apparatus for removing carbonaceous material from opposite lateral surfaces of a coke oven door comprising:

(a) first and second generally cylindrical cutting drums, each of said cutting drums having a curved peripheral cutting surface which is positionable against the coke oven door;

(b) first and second spaced, parallel through shafts, respectively coaxial with and connected end to end to the first and second cutting drums so as to transmit rotational motion to said cutting drums;

(c) means for rotating said first and second through shafts and their attached cutting drums about their longitudinal axes so as to effect the removal of carbonaceous material from the coke oven door;

(d) a common shaft perpendicularly interposed between the first and second parallel through shafts;

(e) means for transmitting rotational motion between the first and second parallel through shafts and said common shaft;

(f) rotational output means for displacing the apparatus on a vertical support; and (g) means for transmitting and reducing the rate of rotational motion between the common shaft and said rotational output means, such that the apparatus is vertically displaced at a rate which is proportional to the rate at which carbonaceous material is removed from the coke oven door.

2. A self displacing apparatus for simultaneously removing hard carbonaceous material from opposite lateral surfaces of a coke oven door and viscous carbonaceous material from a seal ring surface on a coke oven door comprising:

(a) first and second generally cylindrical cutting drums, each of said cutting drums having a curved peripheral cutting surface which is positionable against the coke oven door;

(b) first and second spaced, parallel through shafts, respectively coaxial with and connected end to end to the first and second cutting drums so as to transmit rotational motion to said cutting drums;

(c) means for rotating said first and second through shafts and their attached cutting drums about their longitudinal axes so as to effect the removal of hard carbonaceous material from the coke oven door;

(d) a common shaft perpendicularly interposed between the first and second parallel through shafts;

(e) means for transmitting rotational motion between the first and second parallel through shafts and said common shaft;

(f) rotational output means for displacing the apparatus on a vertical support;

(g) means for transmitting and reducing the rate of rotational motion between the common shaft and said rotational output means, such that the apparatus is vertically displaced at a rate which is proportional to the rate at which hard carbonaceous material is removed from the coke oven door;

(h) first and second spaced, parallel upper crank shafts which are disposed parallel to and above the first and second through shafts and which both have at least one attached crank;

(i) first and second upwardly extending scraper arms which are attached, respectively, to the cranks of the first and second upper crank shafts and which both have at their terminal ends upper scraper elements which are positionable against the seal ring surface;

(j) first and second lower crank shafts which are disposed parallel to and below the first and second through shafts and which both have at least one attached crank;

(k) first and second downwardly extending scraper arms which are attached, respectively, to the cranks of the first and second lower crank shafts and which both have at their terminal ends lower scraper elements which are positionable against the seal ring surface; and (l) means for transmitting rotational motion from the first through shaft to the first upper and lower crank shafts and from the second through shaft to the second upper and lower crank shafts, such that the upper and lower scraper elements are linearly reciprocated on the seal ring surface so as to remove viscous carbonaceous material therefrom.

3. An apparatus for removing carbonaceous deposits from a seal ring surface on a coke oven door comprising:

(a) first and second parallel upper crank shafts, said upper crank shafts being disposed to opposite sides of the coke oven door and which both have at least one attached crank;

(b) first and second upwardly extending scraper arms which are attached, respectively, to the cranks of the first and second upper crank shafts and which both have at their terminal ends upper scraper elements which are positionable against the seal ring surface;

(c) first and second lower crank shafts which are disposed, respectively, below said first and second upper crank shafts and which both have at least one attached crank;

(d) first and second lower scraper arms which are attached, respectively, to the cranks of the first and second lower crank shafts and which both have at their terminal ends lower scraper elements which are positionable against the seal ring surface; and (e) means for rotating said first and second upper crank shafts and first and second lower crank shafts, such that the upper and lower scraper elements are linearly reciprocated on the seal ring surface so as to remove carbonaceous material therefrom.

4. The apparatus as defined in claim 1 or 2 wherein on the peripheral cutting surface of the cutting drums there are a plurality of radially outwardly extending and longitudinally arranged blades which are spaced at equal circumferential intervals.

5. The apparatus as defined in claim 4 wherein the cutting drums have the shape of a trucated cone coaxially joined at its base with a cylinder, such that said cutting drums are adapted to fit against outwardly flared lateral surfaces of the coke oven door.

6. The apparatus as defined in claim 5 wherein the cutting drums are detachable from the through shafts.

7. The apparatus as defined in claim 1 or 2 wherein the means for rotating the first and second through shafts is a pair of hydraulic motors and wherein one of said pair is attached to the first through shaft and the other is attached to the second through shaft.

8. The apparatus as defined in claim 7 wherein the hydraulic motors rotate the first and second through shafts in opposite directions.

9. The apparatus as defined in claim 1 or 2 wherein the means for transmitting rotational motion between the first through shaft and the common shaft is a pair of intermeshing beveled gears, one of which is fixed to the second through shaft and the other of which is fixed to the common shaft.

10. The apparatus as defined in claim 1 or 2 wherein the rotational output means for displacing the apparatus on a vertical support is an output pinion ring which engages with a rack on a vertical column.

11. The apparatus as defined in claim 10 wherein the means for transmitting and reducing the rate of rotational motion between the common shaft and the output pinion ring is a reduction gearing system.

12. The apparatus as defined in claim 11 wherein there is fixed to the common shaft a spur gear which intermeshes with a reduction output ring which is connected to a shaft which is attached to a planetary gear system.

13. The apparatus as defined in claim 3 wherein a rotating first through shaft is interposed between the first upper and lower crank shafts and is connected to said first upper and lower crank shafts by a means for transmitting its rotational motion thereto, and where a rotating second through shaft is also interposed between the second upper and lower crank shafts and is connected to said second upper and lower crank shafts by a means for transmitting its rotational motion thereto.

14. The apparatus as defined in claim 2 or 13 wherein the first through shaft is equipped with two chain sprockets, one of which is connected by means of a continuous chain to a chain sprocket on the first upper crank shaft and the other of which is attached by means of a continuous chain to a chain sprocket on the first lower crank shaft, and wherein the second through shaft is also equipped with two chain sprockets one of which is attached by means of a continuous chain to a chain sprocket on the second upper crank shaft and the other of which is equipped by means of a continuous chain to a chain sprocket on the second lower crank shaft.

15. The apparatus as defined in claim 2 or 3 wherein the first and second upwardly extending scraper arms and the first and second downwardly extending scraper arms are each connected to a dampening means.

16. The apparatus as defined in claim 2 or 3 wherein the upper and lower scraper elements are discs which are rotatable about their central axes.

17. The apparatus as defined in claim 3 wherein there is provided a means for vertically displacing the apparatus with respect to the coke oven door.

* * * * *